US005372494A

United States Patent [19]

Vaughan

[11] Patent Number: 5,372,494

[45] Date of Patent: Dec. 13, 1994

[54] ADJUSTABLE PERFORATING ROLLER FOR SHEET MATERIAL

[75] Inventor: Donald E. Vaughan, Chesterfield County, Va.

[73] Assignee: Reynolds Metals Company, Richmond, Va.

[21] Appl. No.: 186,081

[22] Filed: Jan. 25, 1994

[51] Int. Cl.[5] ..... B26F 1/24

[52] U.S. Cl. ..... 425/196; 83/660; 264/156; 425/194; 425/290; 425/DIG. 37; 492/36

[58] Field of Search ..... 425/182, 183, 194, 196, 425/290, 291, DIG. 37; 83/660; 139/296; 264/156; 492/31, 33, 36

[56] References Cited

U.S. PATENT DOCUMENTS

| | | | |
|---|---|---|---|
| 1,357,141 | 10/1920 | Bibb | 425/194 |
| 1,873,041 | 8/1932 | Robinson | 425/194 |
| 2,519,355 | 4/1946 | Cox, Jr. | 493/403 |
| 2,949,634 | 8/1960 | Shipley | 425/194 |
| 3,092,439 | 3/1961 | Harrison | 264/154 |
| 3,137,893 | 6/1964 | Gelpke | 425/290 |
| 3,227,854 | 1/1966 | Ramsey et al. | 219/244 |
| 3,546,742 | 12/1970 | Kugler | 425/290 |
| 3,760,477 | 9/1973 | Koch | 492/38 |
| 3,812,561 | 5/1974 | Lundgren | 492/33 |
| 3,891,494 | 6/1975 | Hunter | 425/290 |
| 4,116,594 | 9/1978 | Leanna et al. | 425/3 |
| 5,173,313 | 12/1992 | Sato et al. | 425/183 |

*Primary Examiner*—James P. Mackey
*Attorney, Agent, or Firm*—Alan T. McDonald

[57] ABSTRACT

An apparatus for perforating packaging film which includes a cylindrical roller which is rotatable about a longitudinal axis. Bearings are mounted to each end of the roller to facilitate rotation. A number of longitudinal, circumferentially spaced grooves are formed in the outer surface of the roller. Perforation pin holders are removably and adjustably mounted in the grooves. The perforating pins are removably or permanently mounted on the holder.

16 Claims, 2 Drawing Sheets

ADJUSTABLE PERFORATING ROLLER FOR SHEET MATERIAL

BACKGROUND OF INVENTION

1. Field of the Invention

This invention relates to apparatus for perforating sheet materials. More particularly, this invention pertains to an adjustable perforating roller suitable for perforating sheet material, such as thin bioriented polyvinyl chloride, which is commonly utilized as a packaging or wrapping material. The invention is particularly suitable for perforating shrink wrap packaging materials.

2. Description of the Related Art

In the use of heat shrinkable film, especially in the packaging field, it has been found necessary to provide holes or apertures in the packaging materials. These apertures serve various purposes, including the release of air from between the film and package so that the film can be shrunk tight over the package.

Prior attempts to produce perforations in thermoplastic film material have encountered substantial obstacles. One prior art apparatus uses a heated, pin-carrying, film perforating roll in conjunction with an annularly grooved anvil roll to perforate film material. It has been found that this apparatus tends to produce longitudinally extending ridges in the perforated film which are generally undesirable. This apparatus also tends to produce uneven or nonuniform film perforations.

The heating of the perforating roll of the above-described apparatus inherently induces longitudinal roll expansion, particularly where long rolls are employed to handle large widths of film. Considerable difficulty has been encountered with respect to misalignment of the perforating roll pins in the anvil roll and annular grooves caused by such longitudinal expansion of the pin roll.

Perforating apparatus for placing small apertures in shrink wrap packaging materials to allow air to escape as the material is being shrunk around the package are conventionally comprised of a sleeve having multiple perforating pins, which can be fit over an idler roll. Because different sizes, shapes and locations of perforations are required, depending on the application, users often must have a number of different sleeves available for use in different applications.

This can be very costly, since special sleeves must be made or purchased for each separate application. Furthermore, because the diameter of the idler rolls often vary from machine to machine, multiple sleeves or sleeve spacers may be required in order to make identical perforations in the same material using different machines. Additionally, these sleeves are difficult to install and remove when different perforation sizes, shapes and/or locations are required. Also, is difficult to adjust the perforation pin sizes, shapes or locations without substituting one sleeve with another.

Thus, it is an object of the present invention to provide a perforating apparatus which does not require special sleeves for each separate application. It is also an object of the invention to provide a perforating apparatus which does not require heated perforating pins. It is a further object of the invention to provide a perforating apparatus which has a constant outside diameter and can be used on a number of machines for the same application without the need for spacers or other adjustment devices. It is still another object of the present invention to provide a perforating apparatus which is easily adaptable to a variety of applications which require different perforation sizes, shapes and/or locations. It is yet another object of the present invention to provide a perforating apparatus which is easily adaptable to a variety of applications without the need to install and remove a roller and/or sleeve. It is also an object of the present invention to provide a perforating apparatus which simplifies changing the perforation sizes, shapes and/or locations when required. It is a still further object of the present invention to provide a perforating apparatus which allows the perforation pin sizes, shapes or locations to be adjusted in a flexible manner and without requiring roller and/or sleeve removal.

Additional objects, advantages and novel features of the present invention will become apparent to those skilled in the art upon examination of the following, as well as by practice of the invention. While the invention is described below with reference to preferred embodiments for an apparatus for perforating packaging film to obtain proper shrinkage, it should be understood that the invention is not limited thereto. Those of ordinary skill in the art having access to the teachings herein will recognize additional applications, modifications and embodiments in other fields (including, but not limited to the perforating of photo, audio, and video film), which are within the scope of the invention as disclosed and claimed herein and with respect to which the invention could be of significant utility.

SUMMARY OF THE INVENTION

The present invention provides an apparatus for perforating sheet materials, including thermoplastic and other shrink wrap packaging films. According to the invention, the perforating apparatus takes the form of a cylindrical roller which is rotatable about a longitudinal axis. Bearings are mounted to each end of the roller to facilitate the rotation. Longitudinal grooves formed in the outer surface of the roller are circumferentially spaced and preferably extend from one end of the roller to the other. Three or more perforation device holders are removably and, if desired, adjustably mounted in the grooves, with perforating devices, preferably perforating pins, either permanently or removably mounted on the holders.

According to one aspect of the invention, the grooves have a radial cross section which has a wider and a narrower dimension in the radial direction. Preferably, the radial cross section has a step type structure, but the groove cross section could be formed into any other shape which will suitably support the perforation device holders within the groove during perforation of the film. The perforation device holders, when mounted within a groove, do not protrude above the outer surface of the roller. It is, however, most preferable to have the outer surface of the holder flush with the outer surface of the roller.

The holder can be temporarily or permanently secured at any selected location within the groove by an appropriate locking mechanism. For example, the locking mechanism can be a recessed head screw engaged in a tapped threaded hole in the holder. As the screw is tightened it will bear against the bottom surface of the groove. This in turn will cause the holder to bear against an upper surface of the groove causing the holder to be secured in the groove by friction forces. The length of each holder is preferably less than the length of the groove in which it is mounted. To facilitate adjustment of the holder location, the holders are mounted in a manner which allows all or selected holders to slide within the grooves.

The perforating devices, which are typically perforating pins, protrude above the outer surface of the roller and are preferably removably mounted to the holders. Most preferably, the pins are press fit into place, however, other mounting mechanisms, such as screw fitting, may also be employed. It is also preferred to have at least two perforating devices mounted to each holder. The holders are adjusted so that the perforating devices are located to perforate the packaging film at locations which ensure proper shrinkage of the film. Additionally, in a preferred embodiment of the invention, the perforation of the film is performed without pre-heating the perforation devices.

DESCRIPTION OF THE PREFERRED EMBODIMENT

Figure 1:
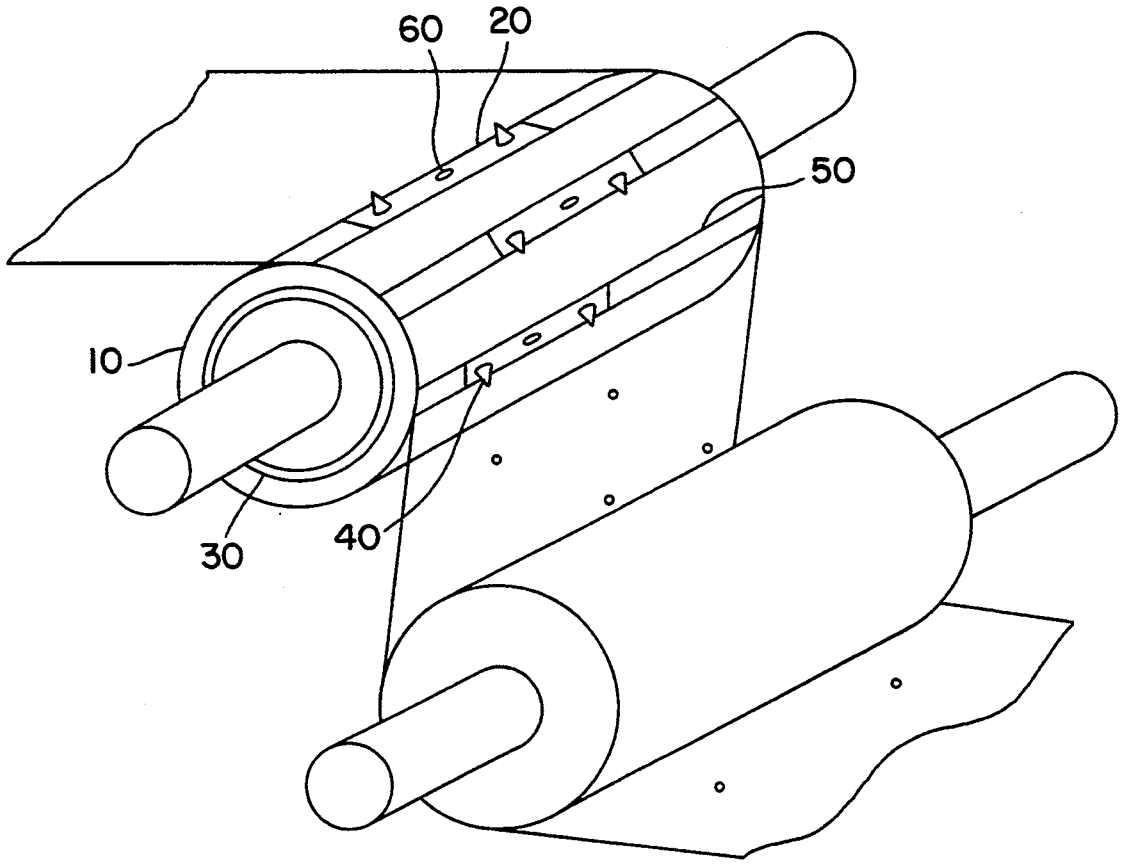
FIG. 1 is a perspective view of the perforation apparatus in accordance with the present invention.
Figure 2:
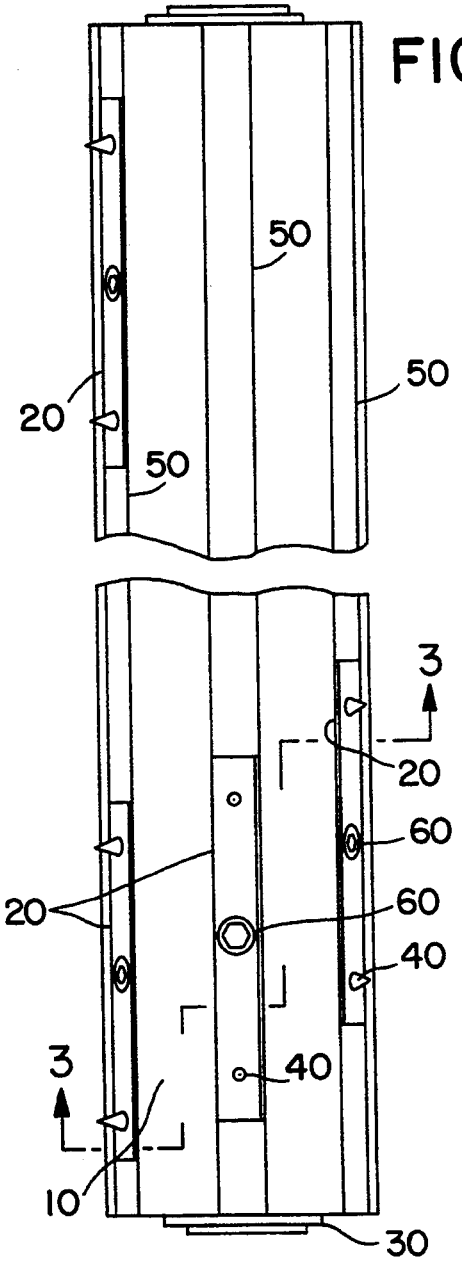
FIG. 2 is a top plan view showing the perforation apparatus in accordance with the present invention.
Figure 3:
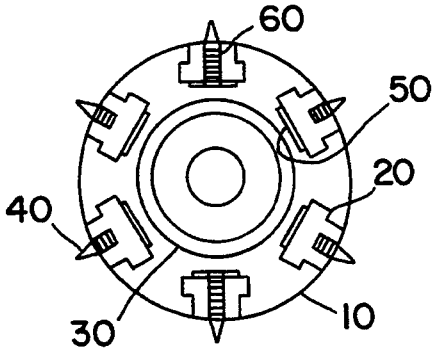
FIG. 3 is a cross sectional view of the apparatus of FIG. 2.

FIGS. 1, 2 and 3 depict the perforation apparatus in accordance with the present invention. The roller 10 is shaped in the form of a cylinder and of suitable length for the machine(s) on which it will be installed. The cylinder has a center shaft and is mounted for free-wheeling rotation. Bearings 30 are attached to each end of the shaft of roller 10. The bearings, once seated, facilitate the rotation of the roller. The bearings shown are of the conventional type used for large cylindrical roller type applications.

Figure 6:
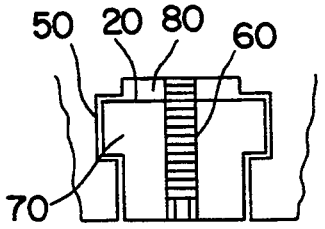
FIG. 6 is an expanded view of the cross section of the groove and perforation pin holder of FIG. 3.

Grooves 50 are formed longitudinally in outer surface of the roller 10. These grooves can be of any shape which allow perforation pin holders 20 to be inserted into the groove, to slide or be otherwise adjusted within the groove to any location between the ends of the roller, and to be supported by and secured within the groove. The grooves can, for example, be given a double step structure as shown in FIGS. 3 and 6 and extend the length of the roller. This facilitates the easy installation and deinstallation of the pin holders as well as the support of the holders once installed. The grooves must be formed in such a manner so that the outer surface of the inserted holder is exposed. The grooves are spaced radially around the roller, preferably each groove being an equal distance from each adjacent groove around the entire circumference of the roller. As shown, the grooves are formed with a double step structure which provides support for the holder in all directions except in a longitudinal direction along the roller 10. Although FIG. 3 illustrates six grooves around roller 10, any number of grooves may be employed. Three is the minimum number of grooves that is sufficient for the preferred embodiment illustrated in FIG. 1 wherein the roller 10 is free-wheeling and at least one of the pins 40 is in engagement with the film to rotate roller 10 at any given time.

The perforation pin holders 20 can be of any desired length but will normally be less than the length of the roller 10. In the preferred embodiment, the holders are approximately 2 inches in length. In a typical application for perforating packaging film, such as thermoplastic film, one or more holders would be inserted in each groove. The holders are then slid to the desired location along the groove and secured in place. If and when desired, the holder can be unsecured and moved to another location or removed from the groove entirely. The longitudinal spacing between holders within a particular groove is also variable. The holders may, for example, be adjusted after a trial run. The holders 20 have an outer surface which is flush with the outer surface of the roller 10.

One or more perforation pins 40 are mounted in the holders 20. The pins are preferably removable from the holder so that pins can be easily exchanged without the need to remove the holder from the groove. For example, the pins may be press fit into the holder or manufactured with a threaded bottom portion which can be screwed into a tapped opening in the holder. Various other connection configurations could also be used to accomplish the removable mounting of the pins. In the embodiment shown, the pins do not require pre-heating before perforating the packaging film. The perforation pins 40 protrude outwardly from the outer surface of the holders.

The holder is secured in place at the desired location along the length of the groove by a threaded, recessed head screw 60 which, when tightened, bears against the bottom surface of groove 50 forcing holder 20 in an outward direction from the center of the roller and against an upper surface of the groove. The holder is thereby locked or secured in place by the bearing friction forces.

Figure 4:
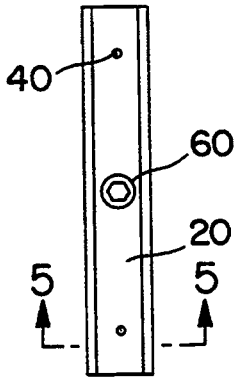
FIG. 4 is a top plan view of the adjustable perforating pin holder of the apparatus of FIG. 2.
Figure 5:
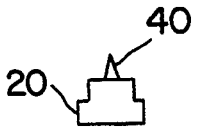
FIG. 5 is a side view of the adjustable perforating pin holder of FIG. 4 with the pins mounted.

The holders 20, as depicted in FIGS. 4 and 5, are shaped so as to conform to the shape of the groove so that they can be easily installed and moved in the groove. The inner step of the groove reduces the friction forces between the groove and holder sliding surfaces during installation of the holder and adjustment of its location. This inner step also provides a bearing surface for the locking screw 60 which is separate from the groove sliding surfaces.

FIG. 6 details the groove 50 and holder 20 assembly. The groove 50 is formed with a double step function. The outer step forms a groove portion which is capable of accepting and supporting inner holder portion 70. This groove portion provides support for the holder in all directions except with respect to longitudinal movement of holder 20 within the groove. The second or inner step forms groove portion 80, the inner surface of which serves as a bearing surface for locking screw 60 when the screw is tightened to longitudinally secure the holder within the groove.

Except as otherwise described above, the various components of the apparatus according to the present invention can be of conventional materials, dimensions and construction. However, other materials, dimensions and construction which have characteristics suitable for use in perforating shrink wrap packaging or other sheet materials in accordance with the present invention could also be used. The perforated packaging film can be collected onto a roller for further use or fed directly to a packaging machine and used for shrink wrapping.

Thus, as described, the present invention provides a perforating apparatus which does not require special sleeves for each separate application. The apparatus also does not require heated perforating pins. The apparatus has a constant outside diameter and therefore can be used on different machines for the same application without the need for spacers or other adjustment devices. The apparatus is easily adaptable to a variety of applications which require different perforation sizes, shapes and/or locations, and without the need to install and remove a roller and/or sleeve. The described perforating apparatus simplifies and facilitates the changing of the perforation sizes, shapes and/or locations when required and allows the perforation pin sizes, shapes or locations to be adjusted in a flexible manner and without requiring roller and/or sleeve removal.

What is claimed is:

1. An apparatus for perforating sheet material comprising:

a. a cylindrical roller having an outer surface and being rotatable about a longitudinal axis;

b. bearing means rotationally mounted to each end of said cylindrical roller and adapted to allow rotation of said roller about said longitudinal axis;

c. a plurality of grooves in said outer surface of said roller circumferentially spaced and longitudinally extending on said roller;

d. at least one holder means removably mounted in One Of said plurality of grooves; and e. one or more perforating means mounted to said at least one holder means, wherein said at least one holder means does not protrude above the outer surface of said roller, wherein said at least one holder means includes a locking means capable of fixably securing said at least one holder means at a selected location within said one of said plurality of grooves, and wherein said locking means is capable of bearing against a bottom surface of said one of said plurality of grooves causing said at least one holder means to bear against another surface of said one of said plurality of grooves to secure said at least one holder means.

2. An apparatus for perforating sheet material according to claim 1, wherein there are at least three holder means removably mounted in said plurality of grooves such that at least one of said perforating means is in engagement with said sheet material at any time.

3. An apparatus for perforating sheet material according to claim 1, wherein the location of said at least one holder means is longitudinally adjustable within said one of said plurality of grooves.

4. An apparatus for perforating sheet material according to claim 1, wherein said plurality of grooves extend from one of the ends of said roller to the other end of said roller.

5. An apparatus for perforating sheet material according to claim 1, wherein each of said grooves has a radial cross section which has a first width to a first depth in the roller and a second larger width thereafter.

6. An apparatus for perforating sheet material according to claim 4, wherein each of said grooves has a radial cross section which has a step structure.

7. An apparatus for perforating sheet material according to claim 1, wherein said at least one holder means has an outer surface which is flush with the outer surface of said roller.

8. An apparatus for perforating sheet material according to claim 1, wherein each said groove has a length and each said holder means has a length which is less than the length of the groove in which said holder means is mounted.

9. An apparatus for perforating sheet material according to claim 3, wherein said at least one holder means is adjustable by sliding said at least one holder means within said one of said plurality of grooves.

10. An apparatus for perforating sheet material according to claim 1, wherein said perforating means protrude above the outer surface of said roller.

11. An apparatus for perforating sheet material according to claim 10, wherein said perforating means are removably mounted.

12. An apparatus for perforating sheet material according to claim 11, wherein said perforating means are press fit mounted.

13. An apparatus for perforating sheet material according to claim 11, wherein said perforating means are screw mounted.

14. An apparatus for perforating sheet material according to claim 11, wherein said perforating means are perforating pins.

15. An apparatus for perforating sheet material according to claim 14, wherein at least two of said perforating means are mounted to each said holding means.

16. An apparatus for perforating packaging film comprising:

a. a cylindrical roller having an inner surface and an outer surface and being rotatable about a longitudinal axis;

b. a bearing rotationally mounted to each end of said cylindrical roller and adapted to allow rotation of said roller about said longitudinal axis;

c. at least three grooves in the outer surface of said roller wherein each of said grooves (i) is circumferentially spaced an equal distance from adjacent grooves and longitudinally extending from one end of said roller to the other end of said roller, and (ii) has a radial cross section having a first groove portion with a first width to a first depth from the outer surface of the roller, a second groove portion with a second width from said first depth to a second depth from said outer surface of the roller, and a third groove portion with a third width to a third depth from the outer surface of the roller, wherein said second width is larger than said first and third widths and said second depth is further from said outer surface of the roller than the first depth and said third depth is further from said outer surface of the roller than the second depth;

d. a plurality of perforation pin holders removably mounted in said grooves, wherein (i) the location of each of said perforation pin holders is longitudinally adjustable within said plurality of grooves, (ii) each said perforation pin holder has an outer surface which is flush with the outer surface of the roller, and (iii) each said perforation pin holder has a radial cross section having a first holder portion adapted to slide longitudinally within said first groove portion and a second holder portion adapted to slide longitudinally within said second groove portion wherein the width of said second holder portion is larger than the width of said first and third groove portions;

e. two perforating pins press fit mounted on each of said plurality of perforation pin holders and protruding above the outer surface of the roller; and f. a locking device screw mounted on each of said plurality of perforation pin holders and capable of being positioned to bear against a surface of said groove at said third depth causing the perforation pin holders to be fixably secured on a temporary basis in a longitudinal direction within said plurality of grooves.

* * * * *